US007718075B2

(12) United States Patent
Banerjee

(10) Patent No.: US 7,718,075 B2
(45) Date of Patent: May 18, 2010

(54) METHOD FOR IMPROVING THE CONSOLIDATION AND DEWATERING OF SUSPENDED PARTICULATE MATTER

(75) Inventor: Sujit Banerjee, Marietta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 312 days.

(21) Appl. No.: 11/815,962

(22) PCT Filed: Feb. 14, 2006

(86) PCT No.: PCT/US2006/005168

§ 371 (c)(1),
(2), (4) Date: Aug. 9, 2007

(87) PCT Pub. No.: WO2006/088865

PCT Pub. Date: Aug. 24, 2006

(65) Prior Publication Data

US 2008/0135194 A1 Jun. 12, 2008

Related U.S. Application Data

(60) Provisional application No. 60/653,052, filed on Feb. 15, 2005.

(51) Int. Cl.
*C02F 1/56* (2006.01)
*C02F 11/14* (2006.01)

(52) U.S. Cl. ..... 210/727; 210/728; 210/730; 210/734; 210/928

(58) Field of Classification Search ..... 210/727
See application file for complete search history.

(56) References Cited

U.S. PATENT DOCUMENTS 3,453,257 A 7/1969 Parmerter et al.
4,443,323 A 4/1984 Horikoshi et al.

(Continued)

FOREIGN PATENT DOCUMENTS

EP 0599440 A1 1/1994

(Continued)

OTHER PUBLICATIONS

Abraham, "Successful Approaches in Avoiding Stickies, Recycling," Tappi Journal 81(2): pp. 79-84 (1998).

(Continued)

*Primary Examiner*—Peter A Hruskoci
(74) *Attorney, Agent, or Firm*—Sutherland Asbill & Brennan LLP

(57) ABSTRACT

Methods are provided for treating suspensions of particles to improve the drainage rate and/or the solids content of flocs of the particles. The method includes the steps of (i) providing a suspension which comprises particles in a fluid; (ii) adding a cyclodextrin compound to the suspension; and (iii) dewatering the suspension by removing at least a portion of the fluid to form a cake comprising the particles. The cyclodextrin compound desirably is added in an amount effective to increase the dewatering rate of the flocs, to increase the solids content, or both, over that rate, solids content, or both, that would be obtained without the addition of the cyclodextrin compound. The suspension may be, for example, a biological or non-biological sludge, or a suspension of pulp fibers, such as in a pulping or papermaking process.

20 Claims, 4 Drawing Sheets

U.S. PATENT DOCUMENTS

| | | | |
|---|---|---|---|
| 4,724,045 | A | 2/1988 | Ackel |
| 4,781,794 | A | 11/1988 | Moreland |
| 4,956,051 | A | 9/1990 | Moreland |
| 5,155,219 | A | 10/1992 | Kim et al. |
| 5,376,280 | A | 12/1994 | Wilhelm et al. |
| 5,626,718 | A | 5/1997 | Philippe et al. |
| 5,846,433 | A | 12/1998 | Sorensen et al. |
| 6,103,064 | A | 8/2000 | Asplund et al. |
| 6,521,134 | B1 | 2/2003 | Banerjee et al. |
| 6,808,636 | B2 | 10/2004 | Ward et al. |
| 6,977,027 | B2 | 12/2005 | Sharma et al. |
| 2002/0172656 | A1 | 11/2002 | Biedermann et al. |
| 2003/0146172 | A1 | 8/2003 | Brusseau et al. |
| 2006/0124266 | A1 | 6/2006 | Xu et al. |

FOREIGN PATENT DOCUMENTS

| | | | |
|---|---|---|---|
| WO | 2006014563 | A2 | 2/2006 |

OTHER PUBLICATIONS

Banerjee, et al., "Evaluating the Effectiveness of Chemicals for Stickies Control," Institute of Paper Science and Technology, Tappi Journal, pp. 1-7 (2000).

"Cyclodextrin News," Chemical Reviews, 98: pp. 1751-1753 (1998).

Douek, et al., "Survey of Deposits and Contaminants in Mills Using Recycled Fiber," Progress in Paper Recycling, 13(1): pp. 12-22 (2003).

Hashimoto, et al., "Wet-end Properties of Cationic Graft Terpolymerized Polyacrylamides," The Japan Wood Research Society, 50: pp. 271-274 (2004).

Hutten, et al., "Interactions Among Stickies, Fiber, and Water," Institute of Paper Science and Technology, pp. 1-12 (1995).

Jones, "factiva," Dow Jones & Reuters, pp. 1-4 (2005).

Koskinen, et al., "A Sensor for Microstickies," Recycling, pp. 1-9, Aug. 2002.

Pelton, et al., "Flocculation of Polystyrene Latex with Mixtures of Poly (p-vinylphenol) and Poly (ethylene oxide)," Langmuir, 12: pp. 5756-5762 (1996).

Szejtli, "Introduction and General Overview of Cyclodextrin Chemistry," Chemical Reviews, 98(5): pp. 1743-1750 (1998).

Xiao, et al., "Cationic-modified Cyclodextrin nanosphere/anionic Polymer as Flocculation/Sorption Systems," Journal of Colloid and Interface Science, 283: pp. 406-413 (2005).

Yang, et al., "Sludge Compaction with Ash," pp. 1-3 (2005).

Banerjee, Sujit, Sludge Dewatering with Cyclodextrins: A New Cost-Effective Approach, Thirteenth International Water Technology Conference, IWTC 13 2009, Hurghada, Egypt, pp. 395-401.

Christensen, Jimmy Roland, et al., Mechanisms for Overdosing in Sludge Conditioning, Journal of Environmental Engineering, vol. 119, No. 1, Jan./Feb. 1993, pp. 159-171.

Smith, Paul G., et al., Dictionary of Water and Waste Management, 2nd Edition, pp. 88 and 175, 2005.

CH2OH
O
OH
HO
CH2OH
O
OH
HO
O
HO
CH2OH
O
HO
O
HO
O
HO
CH2OH
O
HO
O
HO
O
HO
CH2OH
O
HO
O

METHOD FOR IMPROVING THE CONSOLIDATION AND DEWATERING OF SUSPENDED PARTICULATE MATTER

CROSS REFERENCE TO RELATED APPLICATIONS

This application claims the benefit of U.S. Provisional Application No. 60/653,052, filed Feb. 15, 2005, which is incorporated herein by reference in its entirety.

BACKGROUND OF THE INVENTION

This invention is generally in the field of dewatering wet particulate matter, and more particularly to methods for increasing the rate of dewatering sludge, pulp fibers, or other solid particulate materials and for increasing the solids content of a dewatered cake.

Industrial processes can produce wet solids that require treatment before disposal, use, or reuse. Examples of such processes include the biological treatment of wastewater and the manufacture of pulp and paper. The wet solids are commonly referred to as sludge, and generally comprise a suspension of particles in a liquid. An example of treating sewage sludge is described in U.S. Pat. No. 6,808,636 to Ward et al., which is incorporated herein by reference.

Conventional techniques for treating wet solids include the steps of promoting flocculation of particles and then dewatering of the flocculated particles. Chemical thickeners, such as polymers and lime, are generally used to promote flocculation of the particles to form flocs. Dewatering techniques, which are well known in the art, are used to produce a cake for disposal. Non-limiting examples of such techniques include pressing and centrifugation of the flocculated particles. The resulting cake typically comprises between approximately 15 and 50% solids (i.e., about 85 to 50% water content).

Disposal methods for the cake typically include means such as landfilling, burning, or landspreading. The water content of the cake is merely a deadload. Accordingly, it would be highly advantageous to reduce the water content of the final cake as much as possible, which can be achieved by increasing the solids content of the cake. Thus, there is a need for a method to increase the solids content of a cake derived from dewatered wet solids.

Dewatering is also critical in other applications. For instance, dewatering is particularly important in the processing of fibers, such as pulp. See, for example, U.S. Pat. No. 6,103,064 to Asplund et al., which is incorporated herein by reference. In a conventional process, the pulp is thickened through drainage or pressing during various process operations, for example in a papermaking process. Improving the drainage rate or the solids content of the drained pulp would improve throughput and increase production. Accordingly, a need exists for a method to increase the rate of dewatering, in order to maximize the throughput of the dewatering device.

SUMMARY OF THE INVENTION

Methods are provided for treating suspensions of particles to improve the drainage rate or the solids content of flocs of the particles, to thereby provide better dewatering process throughput and, in the case of sludge, less deadload for disposal. Generally, the method includes the steps of (i) providing a suspension which comprises particles in a fluid; (ii) adding a cyclodextrin compound to the suspension—typically in addition to at least one conventionally used thickening additive; and (iii) dewatering the suspension by removing at least a portion of the fluid to form a cake comprising the particles. The cyclodextrin compound desirably is added in an amount effective to increase the dewatering rate of the flocs, to increase the solids content, or both, over that rate, solids content, or both, that would be obtained without the addition of the cyclodextrin compound. The fluid may be aqueous. In a preferred embodiment, the suspension comprises a biological sludge, a non-biological sludge (e.g., an industrial sludge), or a combination thereof. In another embodiment, the suspension comprises pulp fibers, such as in a pulping or papermaking process.

In a preferred embodiment, the formation of flocs through flocculation of the particles is promoted before the step of adding the cyclodextrin compound. In one embodiment, the step of promoting the formation of flocs is performed by adding a chemical thickener to the suspension. The dewatering step may be carried out by pressing or centrifuging the flocs or a combination thereof. In preferred embodiments, the cyclodextrin compound may be selected from α-cyclodextrin compounds, β-cyclodextrin compounds, and γ-cyclodextrin compounds, or derivatives or and combinations of these. In one embodiment, the amount of the cyclodextrin compound added is between 0.01 and 20 lbs per ton of the particles expressed on a dry solids basis. In another embodiment, the amount of the cyclodextrin compound added is between 0.01 and 2000 mg/liter of the fluid.

In a preferred aspect, a method is provided for dewatering a suspension of particles that includes the steps of (i) providing a suspension which comprises particles in a fluid; (ii) promoting the formation of flocs through flocculation of the particles by the addition of a chemical thickener to the suspension; (iii) adding a cyclodextrin compound to the suspension; and (iv) dewatering the flocs at a dewatering rate to form a cake comprising the particles. In one embodiment, the chemical thickener comprises a polymer, a mineral, or a combination thereof. For instance, the chemical thickener may include alum, lime, a cationic polyacrylamide, or a combination thereof.

DETAILED DESCRIPTION OF THE INVENTION

Methods have been developed for treating a suspension of particles in a fluid to improve both the rate of dewatering and the particle content in a cake formed thereby. The methods advantageously improve the drainage rate or the solids content of flocs of the particles, to thereby provide better dewatering process throughput and, in the case of sludge, less deadload for disposal.

Conventional dewatering processes include steps for promoting the formation of flocs of particles by the flocculation of the particles and then dewatering of the flocs to form cakes, for subsequent use or disposal. Generally, the step of promoting formation of flocs of particles comprises treating the fluid with chemical thickeners to promote particle agglomeration and formation of flocs of particles, which are more easily dewatered than suspended particles. The step of dewatering typically comprises subjecting the flocs to pressing or centrifugation. The present methods improve upon the prior art methods by treating a fluid comprising a suspension of particles with a cyclodextrin compound, which increases the particle content of the cake and the dewatering rate of the flocs.

Figure 1:
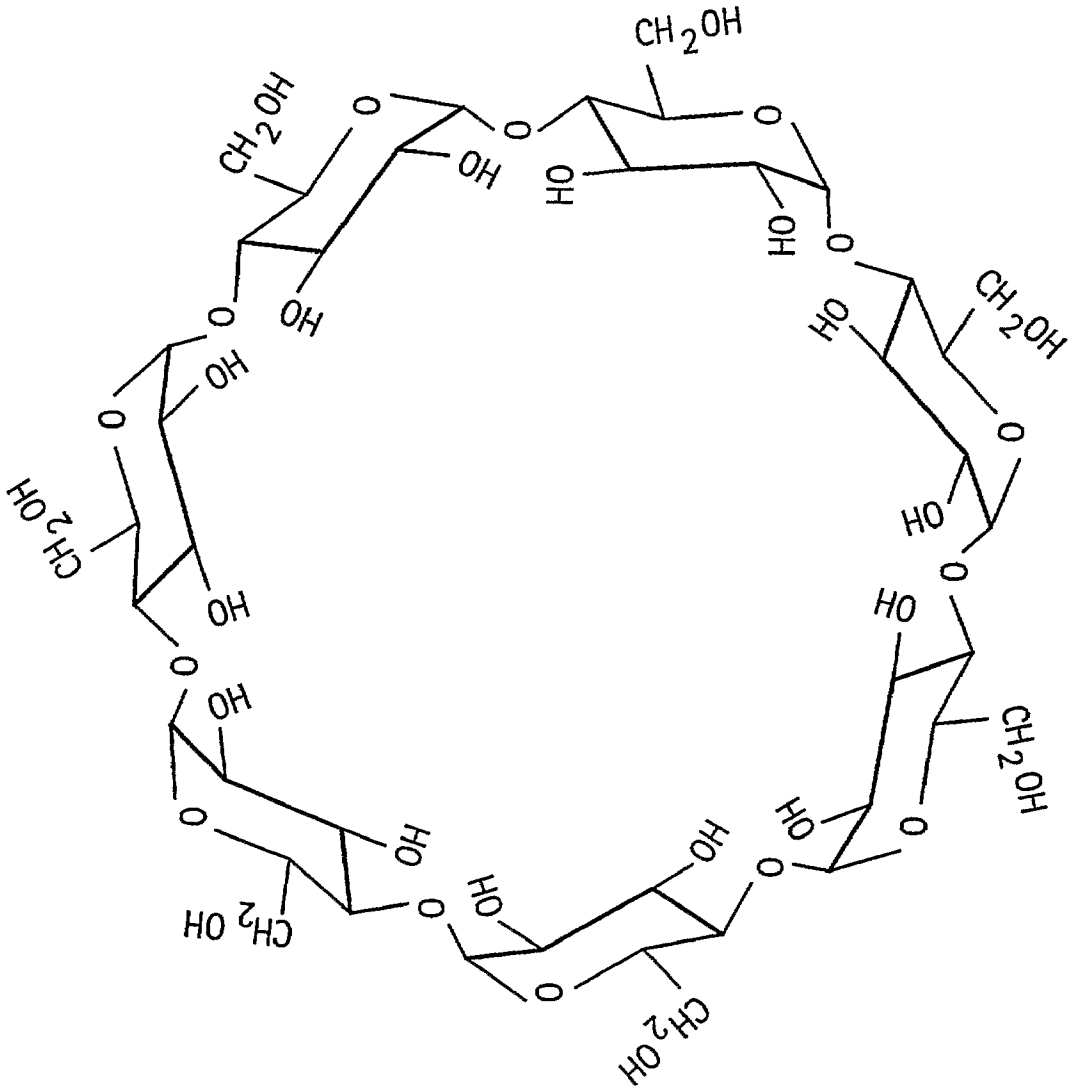
FIG. 1 is an illustration of the structure of β-cyclodextrin.

Advantageously, cyclodextrin compounds are generally significantly less expensive than conventional polymer approaches, due for example to the classification of cyclodextrin compounds as a bulk chemical rather than a specialty chemical and the availability of bulk quantities of cyclodextrin compounds from commercial suppliers (such as the Wacker Chemical Company). As used herein, the term "cyclodextrin compound" refers to any compound in the family of oligosaccharides composed of five or more α-D-glycopyranoside units linked 1→4. Typical cyclodextrin compounds comprise between six and eight glucose monomers in a ring; the α-cyclodextrin compound comprising six glucopyranose units, the β-cyclodextrin compound comprising seven glucopyranose units (illustrated in FIG. 1), and the γ-cyclodextrin compound comprising eight glucopyranose units. In preferred embodiments, the cyclodextrin compound may be selected from an α-cyclodextrin compound, a β-cyclodextrin compound, a γ-cyclodextrin compound, derivatives thereof, and combinations thereof.

Although the three naturally occurring cyclodextrin compounds are most common, cyclodextrin compounds comprising as few as five glucopyranose units to as many as 150 member cyclic oligosaccharides have also been identified. Typically, the structure of the cyclodextrin compound comprises a relatively hydrophobic core and hydrophilic exterior. The hydrophilic exterior imparts water solubility to the cyclodextrin compounds and their complexes. The functional groups of cyclodextrin compounds can be derivatized to alter the properties of the cyclodextrin compounds.

While not wishing to be bound by any theory, it is believed that this unique structure enables cyclodextrin compounds to bind with particles in a suspension of fluid, thereby promoting the formation of flocs by flocculation of the particles and increasing the content of particles in a cake. It is also believed that this contributes to an increased dewatering rate of flocs. These benefits can provide substantial cost savings by reducing the mass and volume of the wet solids requiring disposal and by increasing the efficiency of the dewatering process.

Figure 2:
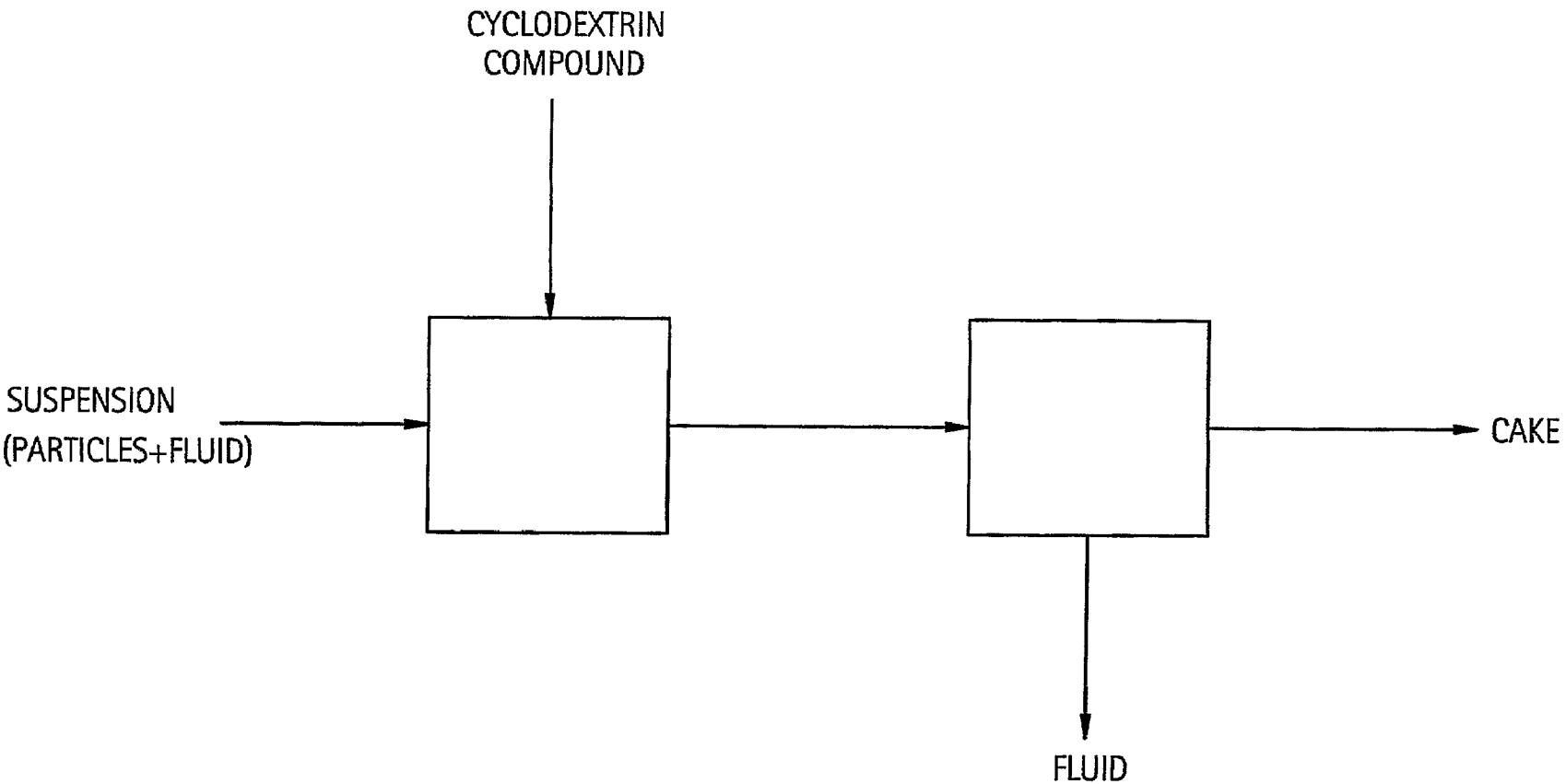
FIG. 2 is a process flow diagram showing the general process steps of the methods described herein.

Generally, the present methods include the steps of (i) providing a suspension which comprises particles in a fluid; (ii) adding a cyclodextrin compound to the suspension; and (iii) dewatering the suspension by removing at least a portion of the fluid to form a cake comprising the particles. See FIG. 2. The cyclodextrin compound desirably is added in an amount effective to increase the dewatering rate of the flocs, to increase the solids content, or both, over that rate, solids content, or both, that would be obtained without the addition of the cyclodextrin compound. In a preferred embodiment, a method for dewatering a suspension of particles includes the steps of (i) providing a suspension which comprises particles in a fluid; (ii) promoting the formation of flocs through flocculation of the particles by the addition of a chemical thickener to the suspension; (iii) adding a cyclodextrin compound to the suspension; and (iv) dewatering the flocs at a dewatering rate to form a cake comprising the particles. The treatment and dewatering methods described herein may be performed in a continuous, batch, or semi-continuous process, depending upon the particular application needs and processing equipment.

The methods are applicable to a variety of different suspensions of particles. The particles may be in particulate, fiber, or fibrid form, or combinations thereof. The particles may be formed of organic matter, inorganic matter, metals, plastics, minerals, biological matter, or combinations thereof. In preferred embodiments, the fluid is aqueous. However, the fluid may also be or include non-aqueous liquids, e.g., organic solvents, etc. In a preferred embodiment, the suspension comprises a biological sludge (e.g., a sewage sludge), a non-biological sludge (e.g., an industrial sludge), or a combination thereof. In another embodiment, the suspension comprises pulp fibers, such as in a pulping or papermaking process.

The step of promoting flocculation can be carried out by essentially any technique known in the art. In a preferred embodiment, the step of promoting the formation of flocs is performed by adding one or more chemical thickeners to the suspension. Suitable chemical thickeners, also called flocculants, are well known in the art and may be selected based, for example, on the particular suspension materials being processed. Representative examples of chemical thickeners include polymers (e.g., a cationic polyacrylamide), minerals (e.g., alum, lime), and combinations thereof. Other examples of useful polymeric flocculants are described in U.S. Pat. No. 6,872,779 to Mori et al., which is incorporated herein by reference.

Figure 3:
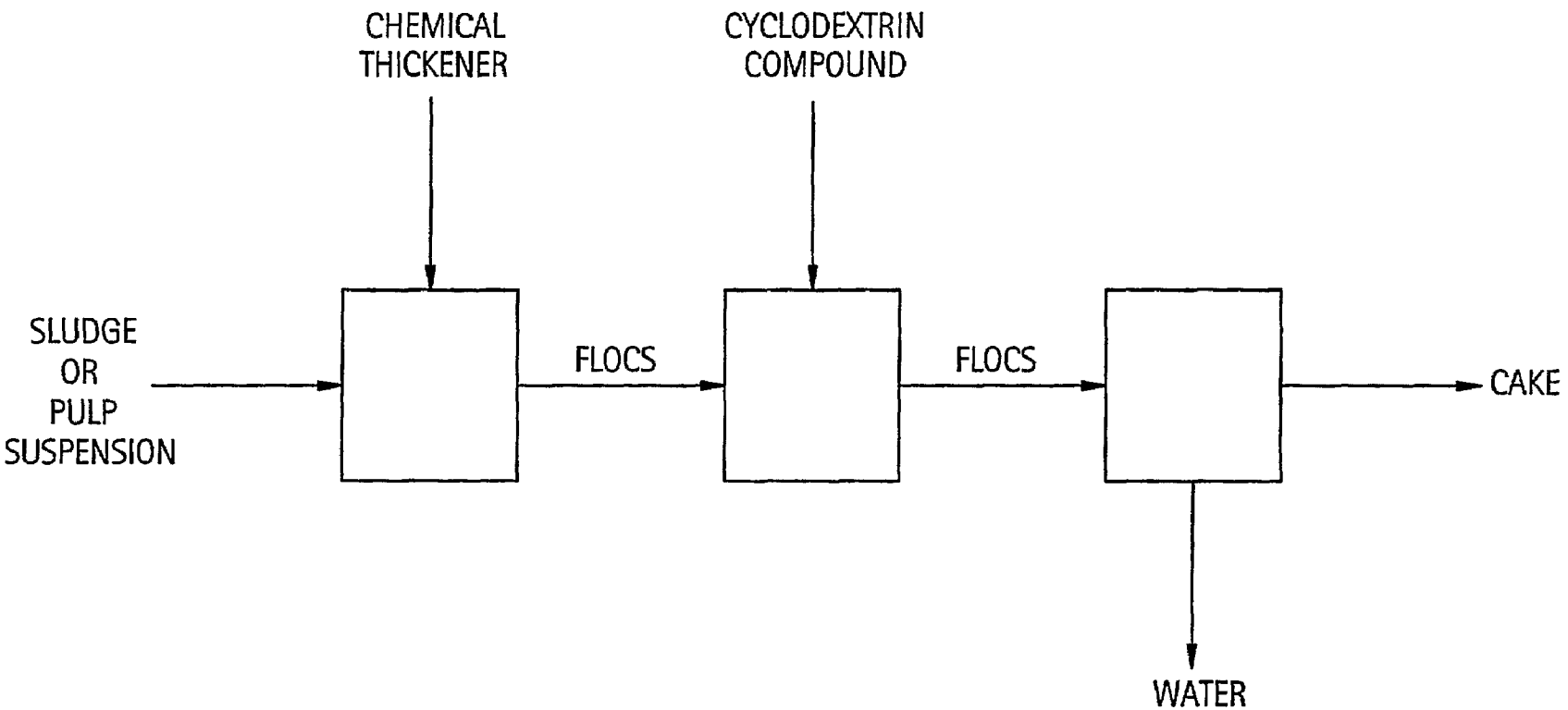
FIG. 3 is a process flow diagram of a particular embodiment of the methods described herein.
Figure 4A:
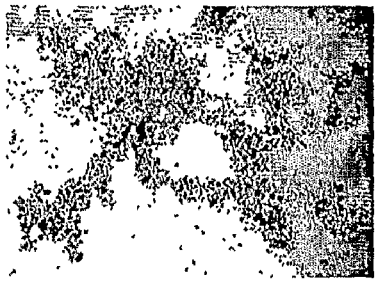
FIG. 4 is a series of electron micrographs showing the effect of adding various concentrations of a cyclodextrin compound on the flocculation of a suspension of biological particles.
Figure 4B:
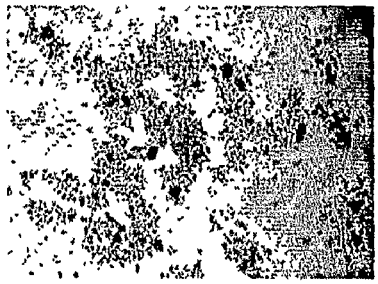
Figure 4C:
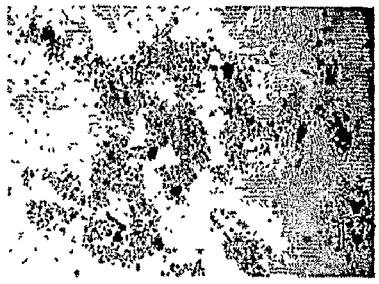
Figure 4D:
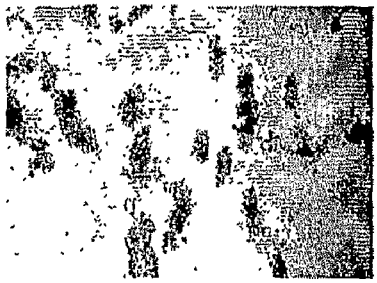
Figure 4E:
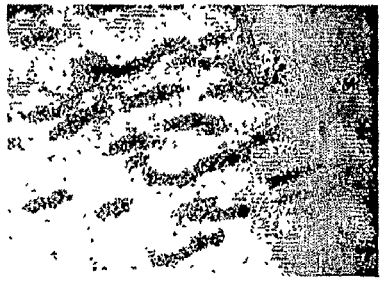

The step of adding the cyclodextrin compound to the suspension can be done before, during, or after the suspension undergoes flocculation. However, the compound preferably is added after pre-treatment of the suspension with a chemical thickener. See FIG. 3. In preferred embodiments, the cyclodextrin compound may be selected from α-cyclodextrin compounds, β-cyclodextrin compounds, and γ-cyclodextrin compounds, or derivatives or and combinations of these. In one embodiment, the amount of the cyclodextrin compound added is between 0.01 and 20 lbs per ton of the particles expressed on a dry solids basis. In another embodiment, the amount of the cyclodextrin compound added is between 0.01 and 2000 mg/liter of the fluid.

The cyclodextrin compound can be added to the suspension in any of several different manners and forms. The cyclodextrin compound may be added by itself, or in a dilute or concentrated solution or suspension with a solvent or non-solvent. The one or more cyclodextrin compounds may be in the form of a composition that includes one or more additional components. It may be introduced into the suspension in a single point or in multiple points, in a continuous or non-continuous manner. It may, for example, be introduced into a process stream using a metering pump, or it may be gravity fed.

The dewatering step can be conducted using processes and equipment well known in the art. In preferred embodiments, the dewatering is carried out by pressing in a press or by centrifuging the flocs in a centrifuge. Combinations of such techniques are envisioned.

The present invention may be further understood with reference to the following non-limiting examples.

Example 1

β-cyclodextrin, obtained from Wacker Chemical Corporation, was added at up to 2 lbs/ton to a biological sludge treated with alum at 10 lbs/ton and cationic polyacrylamide polymer at 25 lbs/ton. This method of treating biological sludge—without a cyclodextrin—is well known in the art. The biological sludge comprised material collected from wastewater treatment systems, and principally, is comprised of microorganisms and debris. The cyclodextrin-treated mixture was drained on the gravity table of a Crown Press, which is a belt press simulator well known in the art. As shown in Table 1, the drainage (the volume of filtrate expressed per unit time) increased with the addition of a cyclodextrin compound.

The specific resistance to filtration (SRF), a standard method for measuring sludge dewaterability, also was obtained by measuring the rate of filtration of sludge through a filter paper under vacuum, a technique described by Yang & Banerjee in "Sludge Compaction with Ash," *Appita J.* (2006), which is incorporated herein by reference. As shown in Table 1, the dewaterability was shown to be improved, that is the SRF decreased, as the cyclodextrin dosage increased.

TABLE 1

Effect of β-cyclodextrin on drainage and SRF of biological sludge

| Lbs cyclodextrin/ Ton biosludge | Drainage increase on gravity table (10#/t alum added, 25#/t c-PAM) | Decrease in specific resistance to filtration |
|---|---|---|
| 0.0 | — | — |
| 0.1 | n/a | 12% |
| 0.5 | n/a | 20% |
| 1.0 | 15% | 34% |
| 2.0 | 16% | 42% |

Example 2

The flocculation of particles of a biological sludge pretreated with a concentration of 0.11 lbs/ton of cationic polyacrylamide polymer was observed under a microscope after addition of various concentrations of β-cyclodextrin. Electron micrographs illustrating the flocculation of particles are shown in FIG. 4. The biological sludge was treated with β-cyclodextrin at amounts as follows in lbs/ton: A=0, B=0.01, C=0.05, D=0.1, E=0.2. As the amount of β-cyclodextrin increased, the consolidation of particles also increased. A cyclodextrin dose of 0.1 lb/odt CD is optimal for this application. It is well known that floc formation improves drainage and dewaterability.

Example 3

A hardwood pulp suspension of 2% by weight was pretreated with cationic polyacrylamide at dosage of 7.5 lbs/ton of pulp. β-cyclodextrin was added at various dosages, and the dewaterability of the pulp was measured using the percent decrease in SRF. As shown in Table 2, the dewaterability improves, that is the SRF decreases, in the presence of β-cyclodextrin. The optimum β-cyclodextrin dosage for this application was about 0.18 lbs/ton.

TABLE 2

Effect of cyclodextrin on the drainage of hardwood pulp

| Cyclodextrin concentration (lbs/ton of pulp) | % decrease in SRF |
|---|---|
| 0.76 | 6.6 |
| 0.38 | 50 |
| 0.18 | 86 |
| 0.09 | 21 |

Example 4

The effect of β-cyclodextrin on dewatering industrial sludge was measured with sludge collected from a newsprint mill in the southeastern United States. The sludge was comprised of ink, fiber debris, and other material. The sludge was first treated with K133L polymer from the Stockhausen Company, a polymer commonly used in sludge dewatering applications, at a dosage of 30 lbs/dry ton of sludge. β-cyclodextrin was added at various dosages, and the mixture pressed in the same Crown Press described in Example 1. As shown in Table 3, the solids content of the cake obtained after pressing clearly illustrates that the cyclodextrin increases the particle content of the cake. Correspondingly, the sludge volume per unit of dry solids is reduced, thereby reducing the volume of sludge requiring disposal in a landfill or otherwise.

TABLE 3

Effect of β-cyclodextrin on cake particle content of industrial sludge

| β-cyclodextrin (lbs/ton) | Particle content of cakes (%) |
|---|---|
| 0 | 28.1 |
| 0.2 | 29.3 |
| 0.4 | 30.5 |

Example 5

The effect of β-cyclodextrin on increasing the solids content of biological sludge was measured with sludge collected from an activated sludge plant located at a paper mill. A conventional polymer, Bulab 5196 from Buckman Laboratories, was added at two dosages to the incoming sludge, which comprised a solids content of 1.4% by weight. As shown in Table 4, the addition of cyclodextrin increased the solids content of the cake by between 1 and 2.4 percentage points, thereby reducing the volume of the sludge requiring disposal in a landfill or otherwise.

TABLE 4

Effect of cyclodextrin on particle content of cakes of biological sludge

| β-cyclodextrin (ppm) | Particle content of cakes (%) |
|---|---|
| Polymer: 5 lbs/ton | |
| 0 | 23.2 |
| 50 | 24.7 |
| 100 | 24.3 |
| 200 | 25.6 |
| Polymer: 3.75 lbs/ton | |
| 0 | 24.1 |
| 50 | 25.4 |
| 100 | 24.9 |
| 200 | 25.1 |

Example 6

The effect was studied of various cyclodextrin compounds (abbreviated as "CD" in Table 5 below) in combination with various commercially available cationic polyacrylamide polymers from Eka Chemical Company and from Hercules Chemical Company on the solids content of cakes obtained from pressing pulp obtained from a linerboard mill in the southeastern United States. The polymers were added to the pulp at a concentration of 4 lbs per dry ton of pulp. Various cyclodextrin compounds of known structure, obtained from Wacker Chemical Company of Munich, Germany, were added at a concentration of 0.2 lbs per dry ton of pulp. The sludges were pressed with a Crown Press. As shown in Table 5, the particle content of the cake increased with the addition of cyclodextrin compounds.

TABLE 5

Effect of CD and polymers on cake particle content (as measured by %)

| Polymer | No CD | α-CD | β-CD | γ-CD | Hydroxy-α-CD (CAVSOL W6 HP) | Hydroxy-β-CD (CAVSOL W7 HP) |
|---|---|---|---|---|---|---|
| Eka PL-2620F | 16.6 | 17.3 | 17.5 | 17.5 | 17.7 | 18.3 |
| Hercules D1373 | 17.6 | 18.7 | 18.7 | 19.4 | 19.2 | 20.2 |
| Hercules PC8715 | 17.6 | 17.5 | 18.9 | 19.0 | 20.0 | 20.7 |
| Hercules PP99 | 17.1 | 17.3 | 17.3 | 18.7 | 18.9 | 17.9 |

Publications cited herein are incorporated by reference. Modifications and variations of the methods and devices described herein will be obvious to those skilled in the art from the foregoing detailed description. Such modifications and variations are intended to come within the scope of the appended claims.

I claim:

1. A method for treating a suspension of particles, the method comprising the steps of:

providing a suspension which comprises particles in a fluid;

promoting the formation of flocs through flocculation of the particles by the addition of a chemical thickener to the suspension;

adding at least one cyclodextrin compound to the suspension, wherein the cyclodextrin compound is selected from the group consisting of α-cyclodextrin, β-cyclodextrin, γ-cyclodextrin, hydroxy-α-cyclodextrin, hydroxy-β-cyclodextrin, and combinations thereof; and dewatering the suspension by removing at least a portion of the fluid to form a cake comprising the particles.

2. The method of claim 1, wherein the step of dewatering comprises pressing the flocs, centrifuging the flocs, or a combination thereof.

3. The method of claim 1, wherein the cyclodextrin compound is β-cyclodextrin.

4. The method of claim 1, wherein the fluid is aqueous.

5. The method of claim 1, wherein the suspension comprises a biological sludge, a non-biological sludge, or a mixture thereof.

6. The method of claim 1, wherein the suspension comprises pulp fibers.

7. The method of claim 1, wherein the cyclodextrin compound is added in an amount effective to increase the dewatering rate of the flocs, the solids content, or both, over that rate, solids content, or both, that would be obtained without the addition of the cyclodextrin compound.

8. The method of claim 1, wherein the amount of the cyclodextrin compound added is between 0.01 and 20 lbs per ton of the particles expressed on a dry solids basis.

9. The method of claim 1, wherein the amount of the cyclodextrin compound added is between 0.01 and 2000 mg/liter of the fluid.

10. The method of claim 1, wherein the chemical thickener comprises a polymer, a mineral, or a combination thereof.

11. The method of claim 10, wherein the chemical thickener comprises alum, lime, a cationic polyacrylamide, or a combination thereof.

12. The method of claim 10, wherein the cyclodextrin compound is added in an amount effective to increase the dewatering rate of the flocs over that rate that would be obtained without the addition of the cyclodextrin compound.

13. The method of claim 10, wherein the cyclodextrin compound is added in an amount effective to increase the solids content of the cake over that solids content that would be obtained without the addition of the cyclodextrin compound.

14. The method of claim 1, wherein the chemical thickener comprises alum and a cationic polyacrylamide polymer and the cyclodextrin compound comprises β-cyclodextrin.

15. A method for treating a biological sludge, the method comprising the steps of:

providing a biological sludge which comprises a suspension of particles in a fluid;

promoting the formation of flocs through flocculation of the particles by the addition of a chemical thickener to the biological sludge;

adding at least one cyclodextrin compound to the biological sludge, wherein the cyclodextrin compound is selected from the group consisting of α-cyclodextrin, β-cyclodextrin, γ-cyclodextrin, hydroxy-α-cyclodextrin, hydroxy-β-cyclodextrin, and combinations thereof; and dewatering the biological sludge by removing at least a portion of the fluid to form a cake comprising the particles.

16. The method of claim 15, wherein the chemical thickener comprises alum and a cationic polyacrylamide polymer.

17. The method of claim 15, wherein the cyclodextrin compound is β-cyclodextrin.

18. A method for treating a non-biological sludge, the method comprising the steps of:

providing a non-biological sludge which comprises a suspension of pulp fibers in a fluid;

promoting the formation of flocs through flocculation of the pulp fibers by the addition of a chemical thickener to the non-biological sludge;

adding at least one cyclodextrin compound to the industrial sludge, wherein the cyclodextrin compound is selected from the group consisting of α-cyclodextrin, β-cyclodextrin, γ-cyclodextrin, hydroxy-α-cyclodextrin, hydroxy-β-cyclodextrin, and combinations thereof; and dewatering the non-biological sludge by removing at least a portion of the fluid to form a cake comprising the pulp fibers.

19. The method of claim 18, wherein the chemical thickener comprises a cationic polyacrylamide polymer.

20. The method of claim 18, wherein the cyclodextrin compound is β-cyclodextrin.

* * * * *